US011634302B2

(12) United States Patent
Nolting et al.

(10) Patent No.: US 11,634,302 B2
(45) Date of Patent: Apr. 25, 2023

(54) ELEVATOR BELT MONITORING APPARATUS AND BLADE CONTACT

(71) Applicant: Weidmüller Interface GmbH & Co. KG, Detmold (DE)

(72) Inventors: Reinhard Nolting, Detmold (DE); Marco Waldhoff, Steinheim (DE); Niels Dallman, Brilon (DE); Christopher Smith, Steinhagen (DE)

(73) Assignee: WEIDMÜLLER INTERFACE GMBH & CO. KG

( * ) Notice: Subject to any disclaimer, the term of this patent is extended or adjusted under 35 U.S.C. 154(b) by 0 days.

(21) Appl. No.: 17/446,850

(22) Filed: Sep. 3, 2021

(65) Prior Publication Data

US 2023/0073546 A1 Mar. 9, 2023

(51) Int. Cl.
*B66B 7/12* (2006.01)
*B66B 7/06* (2006.01)

(52) U.S. Cl.
CPC ..... *B66B 7/1223* (2013.01); *B66B 7/062* (2013.01); *B66B 7/064* (2013.01)

(58) Field of Classification Search
CPC ..... B66B 7/062; B66B 7/064; B66B 7/085; B66B 7/1223
See application file for complete search history.

(56) References Cited

U.S. PATENT DOCUMENTS

| | | | | |
|---|---|---|---|---|
| 4,915,645 | A * | 4/1990 | Konnemann | H01R 13/506 439/417 |
| 7,410,033 | B2 * | 8/2008 | Veronesi | B66B 7/1223 187/391 |
| 7,819,690 | B2 | 10/2010 | Faulkner et al. | |
| 10,023,433 | B2 * | 7/2018 | Dold | B66B 7/064 |
| 10,029,888 | B2 * | 7/2018 | Lehtinen | H01R 13/207 |
| 11,174,126 | B2 * | 11/2021 | Dold | H01R 13/422 |
| 2004/0235335 | A1 * | 11/2004 | Schoeffel | H01R 12/675 439/410 |

FOREIGN PATENT DOCUMENTS

EP 2534082 B1 6/2018

* cited by examiner

*Primary Examiner* — Diem M Tran
(74) *Attorney, Agent, or Firm* — Laubscher & Laubscher PC

(57) ABSTRACT

An elevator belt monitoring apparatus includes a housing for receiving an elevator belt and a plurality of blade contacts which are operable to pierce the belt and engage the spaced parallel cords arranged within the belt. A plurality of bridge contacts are connected with adjacent pairs of elevator belt cords and signal contacts are connected with cords at the outer edges of the belts. The signal contacts are connected with a monitoring device which sends and receives signals to the contacts to provide an indication of the condition or deterioration of the belt.

17 Claims, 8 Drawing Sheets

ELEVATOR BELT MONITORING APPARATUS AND BLADE CONTACT

BACKGROUND OF THE INVENTION

Elevator belts are used to raise and lower an elevator car. The belts are typically formed of a flexible material such as rubber or synthetic plastic and contain a plurality of parallel strands or cords formed of metal to increase the strength of the belt. The belts typically have a rectangular cross-sectional configuration and the cords are arranged in spaced relation across the width of the belt. Through use, the cords deteriorate over time which weakens the belt. While elevator belts can be visually inspected, deterioration of the cords normally cannot be detected visually. Accordingly, electrical monitoring systems have been developed which monitor changes in the integrity of the cords within the belts. Such monitoring systems typically use connecting devices which engage the cords within the belt. An electrical signal is delivered to the cords via the connecting devices and changes in the signal are analyzed to provide an indication of deterioration of the cords.

BRIEF DESCRIPTION OF THE PRIOR ART

Elevator belt monitoring devices are known in the patented prior art as evidenced by EP 2 534 082 which discloses an elevator belt monitoring assembly including cord contacting in the nature of screws which penetrate the belt in gaps between adjacent cords so that the screws abut against adjacent cords. Adjacent screws are staggered or offset to engage different pairs of cords. Electrical conductors are connected with at least two of the screws for transmitting an electrical signal between the cords of the belt and a monitoring device.

While the prior devices operate satisfactorily, maintaining contact with the elevator cords can be difficult due to shifting of the cords and the penetrating screws over time. If the screws become separated from the cords, monitoring of the cord condition is no longer possible. In addition, rotating the individual screws into contact with the cords is time-consuming and may lead to inconsistent cord contact The present invention was developed in order to overcome these and other drawbacks of prior elevator belt monitoring devices by providing an improved cord contact assembly.

SUMMARY OF THE INVENTION

Accordingly, it is a primary object of the invention to provide an elevator belt monitoring system in which belt-piercing contacts are used to pierce through the elevator belt and through the spaced cords arranged in the belt. Each contact is configured to contact at least one cord within the belt. The contacts have a blade configuration and include top, side and bottom edges. The bottom edge includes at least one projection configured either to pierce a cord or to engage at least the opposite sides of a cord. The top edge contains a receptacle for receiving a punch or drive tool which is used to propel or force the contact into the belt a sufficient distance to pierce or engage at least one cord within the belt.

In one embodiment, the projections extending in a longitudinal direction and include an end portion terminating in a point which pierces a respective cord. The side edges of the contact and the projection have a sawtooth configuration to stabilize the contact when inserted into the elevator belt. The contacts have a planar configuration, and the thickness of the projection end portions progressively decreases toward the point to facilitate piercing of the respective cord. In addition, the projection end portions may have a stepped configuration and be arranged at an angle relative to the longitudinal direction.

In an alternate embodiment, a pair of spaced projections extend from the contact bottom edge. The projections are spaced by a distance corresponding with a thickness of a cord so that when the contact pierces the elevator belt, the cord is contacted by opposed edges of the pair of projections.

A pair of the contacts are signal contacts which have a single projection configured to pierce the cords adjacent to the opposite side edge of the belt, respectively. The signal contacts each contain a tapered opening for receiving a signal wire. As the signal contacts are forced into the belt, the dire is displaced toward the narrow end of the opening to establish an electrical connection between the wire and the contact. A monitoring device is connected with the wires to deliver an electrical signal to the signal contact and to process a return signal from the signal contacts to indicate a condition of the elevator cords.

In addition to the signal contacts, a plurality of bridge contacts are provided. The bridge contacts have a pair of space projections configured to pierce a pair of adjacent cords, respectively, within the belt.

A housing is provided for receiving the elevator belt. The housing contains a slot within which the belt is arranged, and the contacts are arranged in an array within the housing. In an alternate configuration, the housing includes a bottom portion which receives the belt and a top portion removably connected with the bottom portion. The top portion contains an array of openings for receiving the contacts and a drive or punch assembly may be inserted into the openings and pressed against the contact receptacles to drive the contacts through the elevator belt to engage respective cords. The housing bottom portion includes a pair of side walls to define a channel for receiving the belt. The sidewalls preferably include resilient members which press against the edge portions of the belt to position it within the housing bottom portion with the elevator belt cords aligned with the contact projections.

BRIEF DESCRIPTION OF THE FIGURES

Other objects and advantages of the invention will become apparent from a study of the following description when viewed in the light of the accompanying drawing, in which.

DETAILED DESCRIPTION

Figure 1:
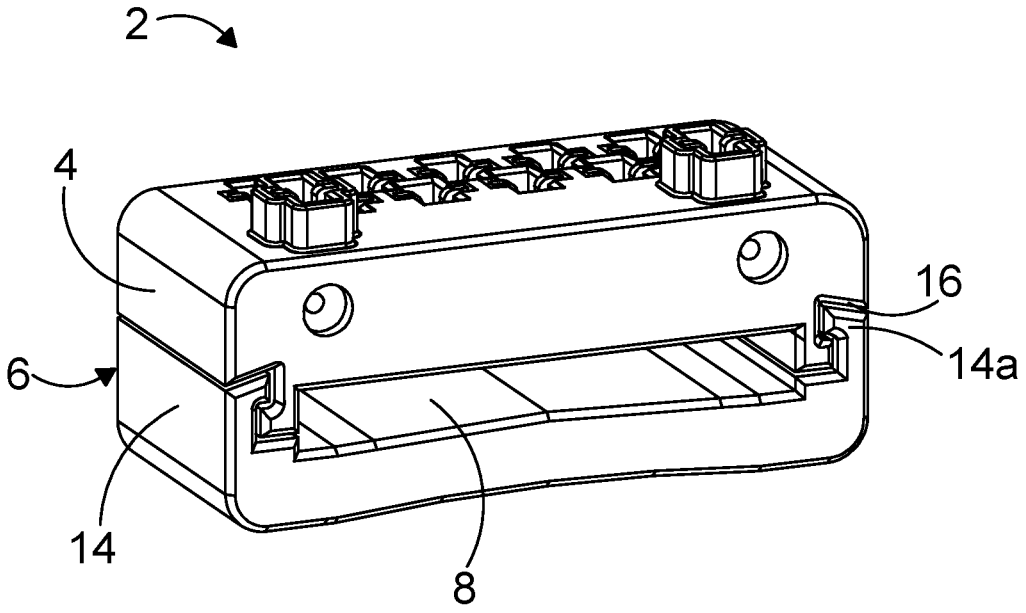
FIG. 1 is a front perspective view of the housing of an elevator belt monitoring apparatus according to the invention.
Figure 2:
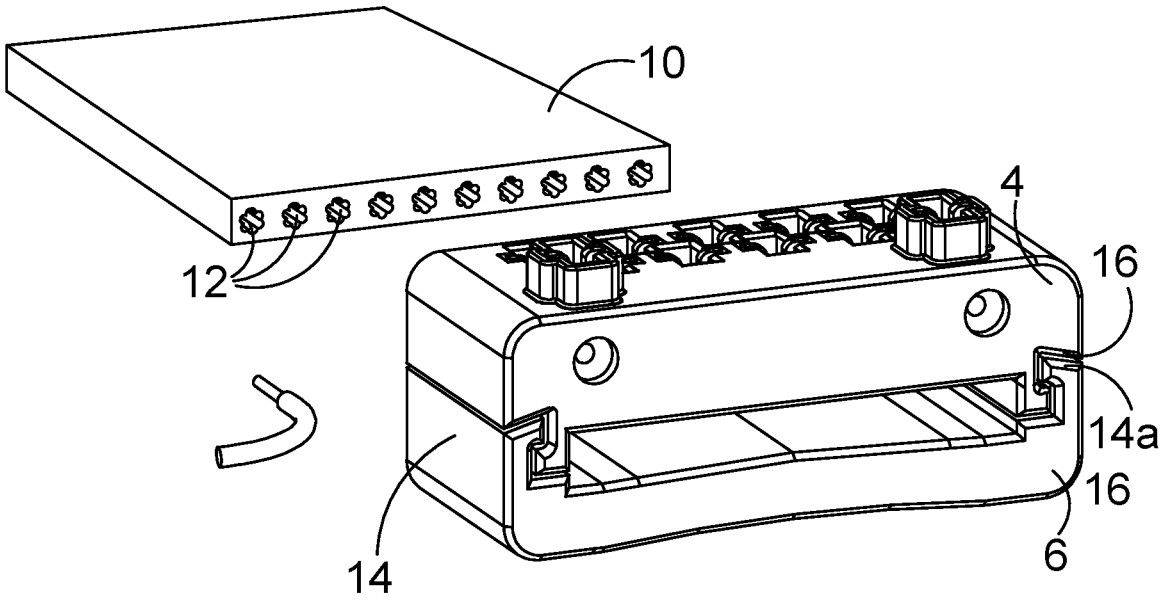
FIG. 2 is an exploded perspective view an elevator belt and the housing of the monitoring apparatus of FIG. 1.

Referring to FIGS. 1-6, an elevator belt monitoring apparatus according to the invention will be described. The apparatus includes a housing 2 having a top portion 4 which is removably connected with a bottom portion 6. The bottom portion contains a longitudinal channel 8 which is configured to receive an elevator belt 10. The belt has a generally rectangular cross-sectional configuration and is formed of a durable flexible material such as rubber or other suitable synthetic material and contains a plurality of longitudinal cords 12 generally arranged in spaced relation across the width of the belt. The cords are typically formed of woven, twisted or braided strands which are formed of a durable material such as metal and serve to reinforce the belt.

Figure 3:
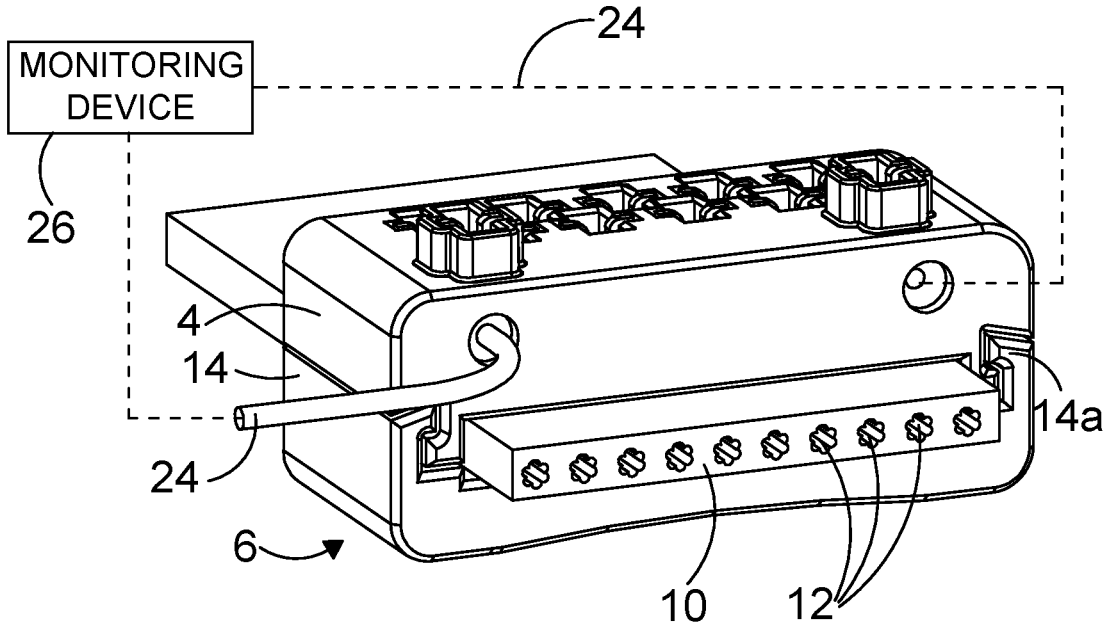
FIG. 3 is a perspective view of the housing of FIGS. 1 and 2 with an elevator belt arranged therein.
Figure 4:
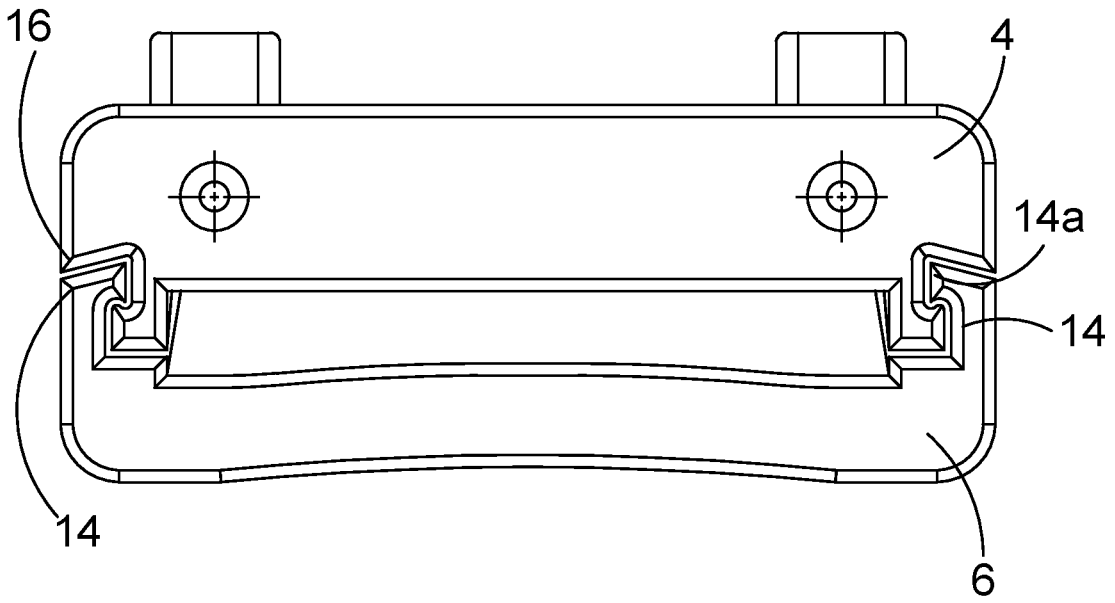
FIGS. 4, 5, and 6 are front, side and top plan views, respectively, of the housing of FIG. 1.
Figure 5:
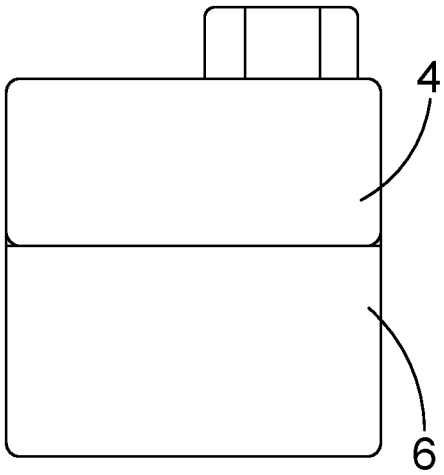
Figure 6:
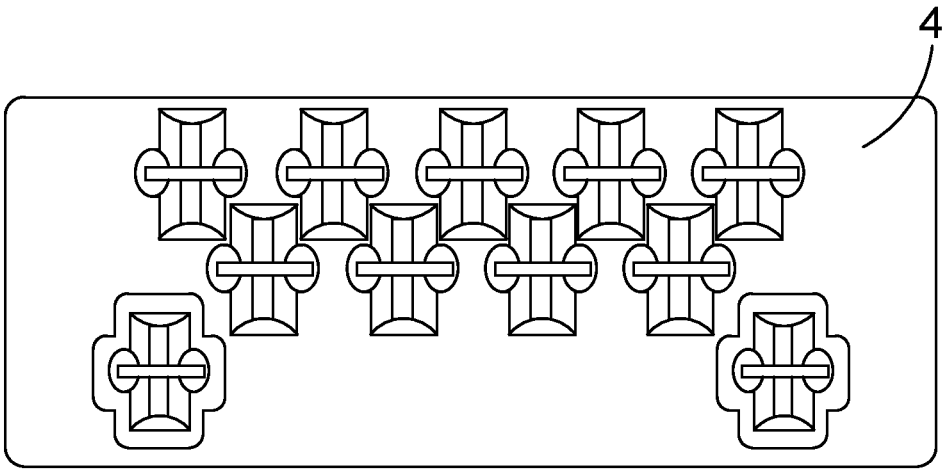

The housing bottom portion includes side walls 14 having inwardly directed projections 14*a* at their upper ends which define an upper portion of the belt receiving channel 8. The inner surfaces of the side walls include resilient members 15 as best shown in FIGS. 11-14 which have a limited degree of flexure and which press against the side edges of the elevator belt to center the belt within the housing channel 8. The housing top portion includes channels 16 in the outer side surfaces thereof which are configured to receive the housing bottom portion projections 14 in a snap-fit connection as shown in FIGS. 3, 4, and 14. Other connection devices between the top and bottom housing portions may be provided including for example a force fit or a hinge connection. Although a two-piece housing is shown with top and bottom portions, it will be appreciated by those of ordinary skill in the art that a unitary, one-piece housing may also be provided.

The housing top portion contains a plurality of openings 18 which are arranged in an array. Belt-piercing contacts are arranged in the openings, respectively, one contact for each opening. The contacts are configured to contact at least one cord 12 within the elevator belt. According to a preferred embodiment, the contacts include bridge contacts and signal contacts.

Figure 7A:
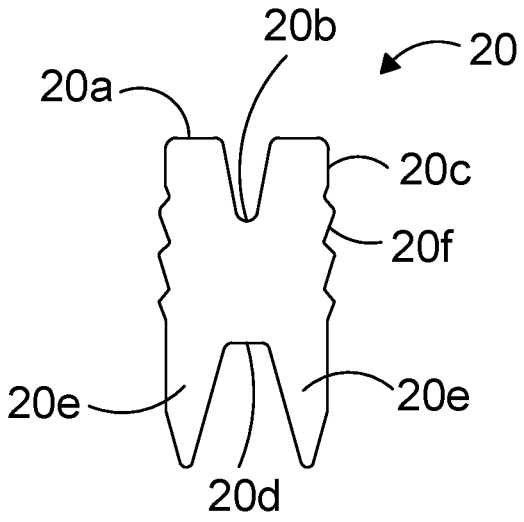
FIGS. 7A and 7B are front plan views of first and second configurations, respectively, of belt piercing bridge contacts of the elevator belt monitoring apparatus according to the invention.
Figure 7B:
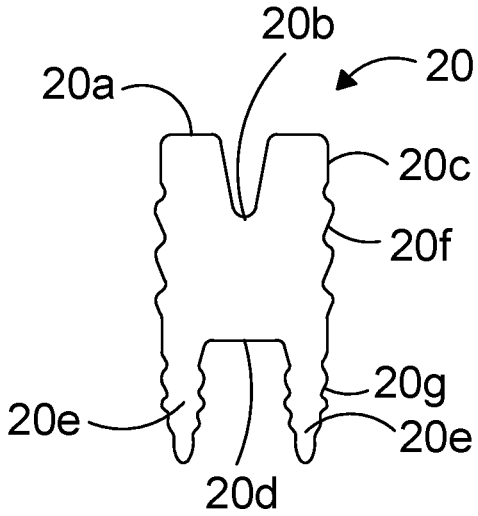

FIGS. 7A and 7B show bridge contacts 20. The contacts are in the form of blades and are formed of a durable conductive material such as metal. The contacts are inexpensive to manufacture as a plurality of contacts can be stamped from a metal sheet. In a preferred embodiment, the blade contacts have a planar configuration, although it will be appreciated that other configurations which enable the contacts to pierce the elevator belt are possible The bridge contacts include an upper edge 20*a* containing a receptacle 20*b*, side edges 20*c*, and a bottom edge 20*d* from which extends a spaced pair of projections 20*e* which extend longitudinally. Preferably, the side edges contain a plurality of angled recesses 20*f* which have a sawtooth configuration. In addition, the inner and outer edges of the projections also contain a plurality of angled recesses 20*g* which also have a sawtooth configuration as shown in FIG. 7B.

Figure 8A:
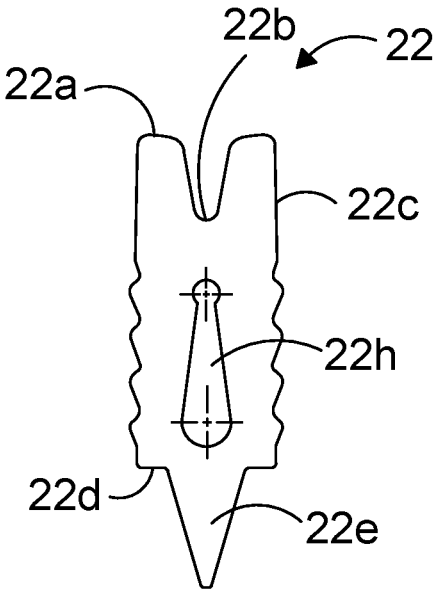
FIGS. 8A and 8B are front plan views of first and second configurations, respectively, of belt piercing signal contacts of the elevator belt monitoring apparatus according to the invention.
Figure 8B:
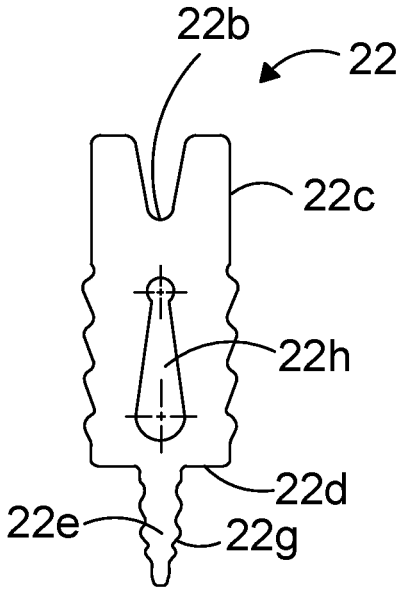

FIGS. 8A and 8B shown signal contacts 22 which are also in the form of blades and formed of a durable conductive material such as metal in the same manner as the bridge contacts 20. The signal contacts include a top edge 22*a* containing a receptacle 22*b*, side edges 22*c*, and a bottom edge 20*d* from which extends a single projection 22*e* in a longitudinal direction. Preferably, the side edges contain a plurality of angled recesses 22*f* which have a sawtooth configuration. In addition, the inner and outer edges of the projection also contain a plurality of angled recesses 22*g* which also have a sawtooth configuration as shown in FIG. 7B. The signal contacts further contain an opening 22*h* which is preferably tapered. As will be developed below, the opening narrows in a direction toward the top edge 22*a* of the contact.

Figure 11:
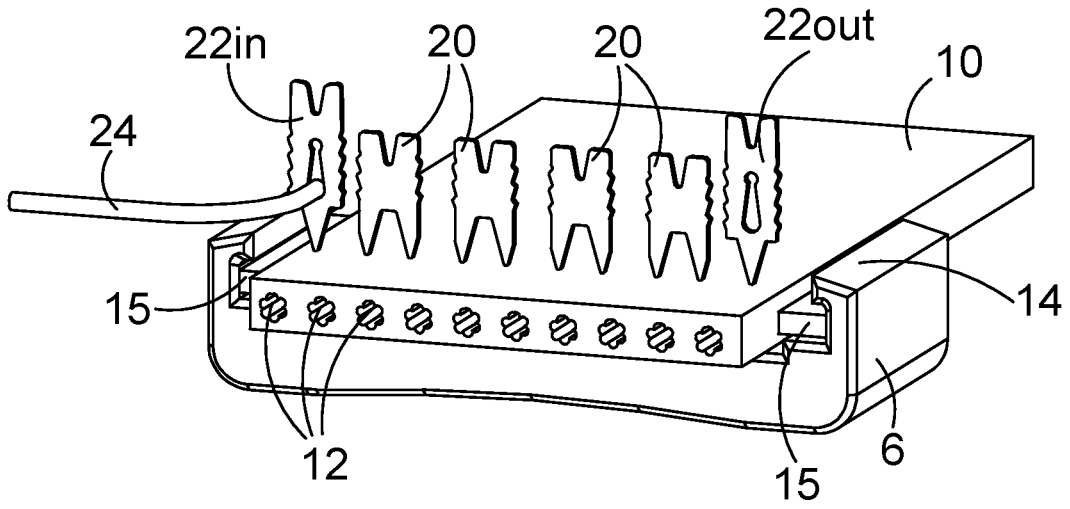
FIGS. 11 and 12 are partial perspective views of the elevator belt monitoring apparatus showing the contacts before and after insertion into an elevator belt, respectively.
Figure 12:
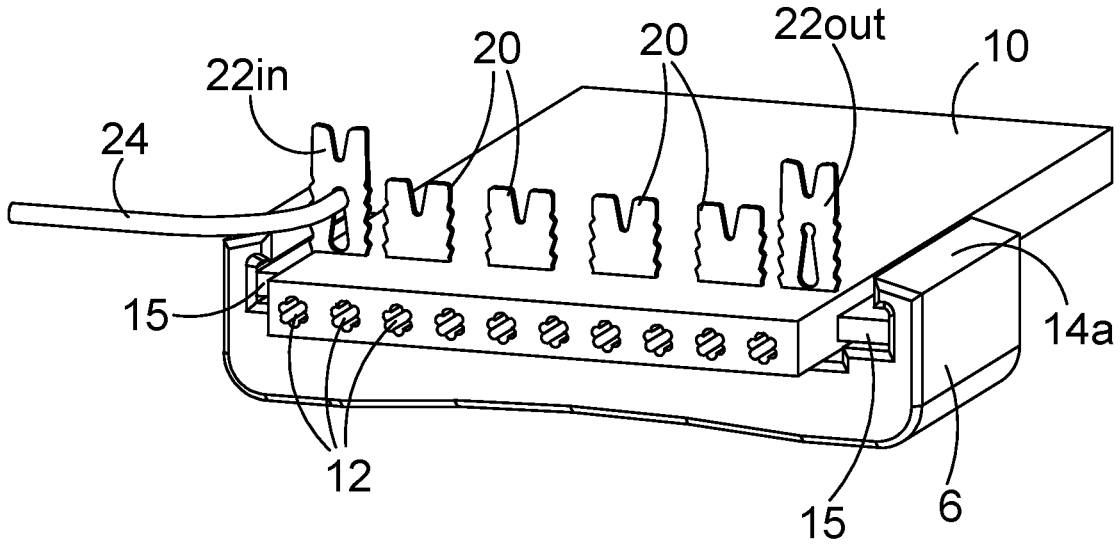
Figure 13:
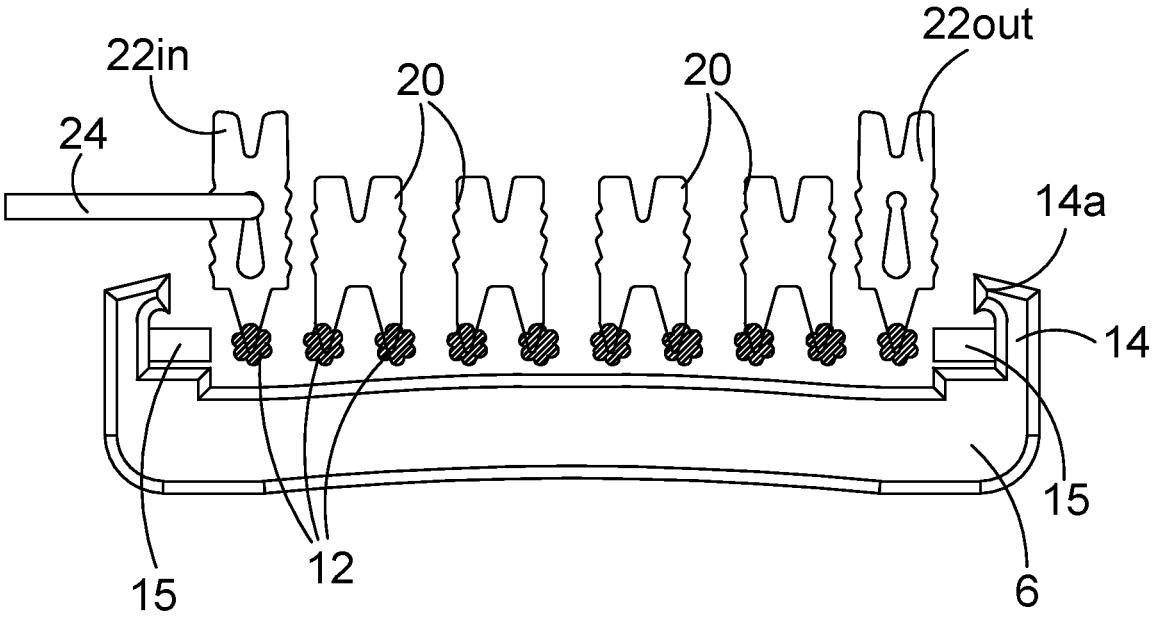
FIG. 13 is a front plan view of the apparatus of FIG. 12 showing the contacts in piercing engagement with the cords of an elevator belt (not shown)
Figure 14:
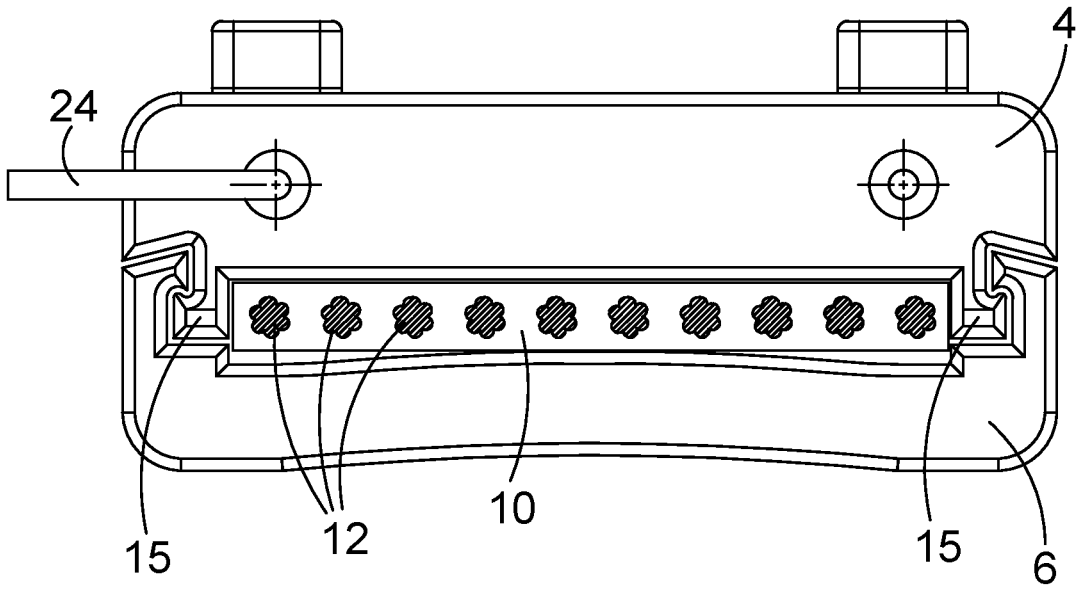
FIG. 14 is front plan view of the housing of FIG. 3 with an elevator belt arranged therein.
Figure 15:
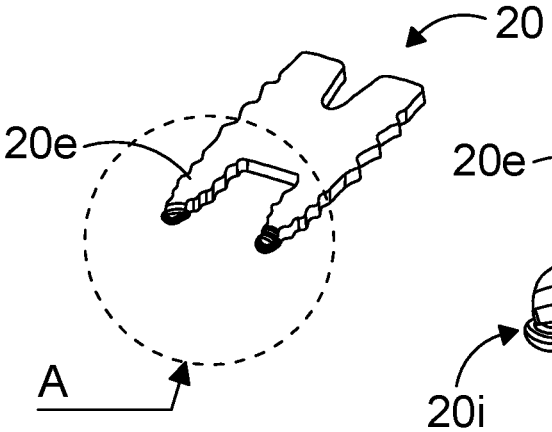
FIG. 15 is a perspective view of the bridge contact shown in FIG. 7B.

Referring to FIGS. 11-13, the signal contacts 22 are arranged relative to the elevator belt 10 above the belt cords 12 at the outer side edges of the belt. The bridge contacts 20 are arranged between the signal contacts 22 and positioned above the belt so that the projections of each bridge contact adjoining cords 12 in the belt.

With the respective bridge and signal contacts arranged in the corresponding openings 18 in the top of the housing and a belt arranged in the housing, a tool such as a screwdriver is insertable into each opening and into the receptacle of each contact in the opening. When a linear force is applied to the tool, it depresses the respective contact into and through the belt so that the projection(s) of each contact pierces a corresponding cord 12 in the belt as shown in FIG. 13. No rotary force is necessary to drive the blade-like contact into the belt. The force is applied for a duration sufficient to displace the contact projections into the corresponding cords. The sawtooth configuration at the edges of the contacts assist in retaining the contacts within the belt and engaged with the cords. At the same time, the contacts are removable from the belt so that the housing is re-usable with another portion of the belt or with a different belt. It will be appreciated that a single driving tool including a plurality of interconnected plunger devices similar to screwdriver blades may be arranged above the housing and operated to drive all of the blades into the belt simultaneously to further simplify and expedite the connection of the bridge and signal contacts of the monitoring system with the respective cords of the belt.

As shown in the drawing, a wire 24 is connected at one end with each signal contact 22. The other ends of the wires are connected with a monitoring device 26 as shown for example in FIG. 3. The monitoring device delivers an electrical input signal to an input signal contact at one edge of the belt and receives a return signal from an output signal contact at the other edge of the belt. The return signal is analyzed in a known manner by the monitoring device and any variations in the return signal from the input signal provide an indication of the condition of the cords. The analyzed signal thus provides an indication of any deterioration of the cords.

Figure 9:
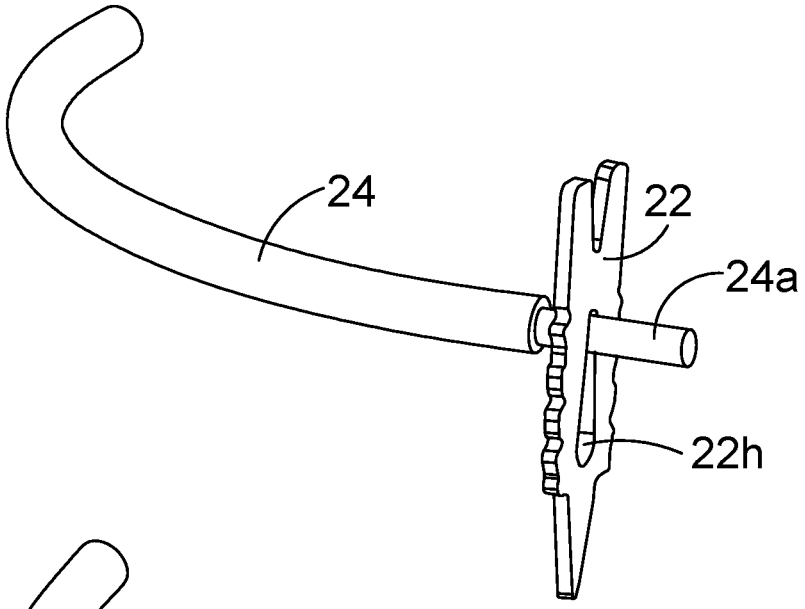
FIGS. 9 and 10 are perspective views of the signal contact of FIG. 8A connected with two different signal wires, respectively.
Figure 10:
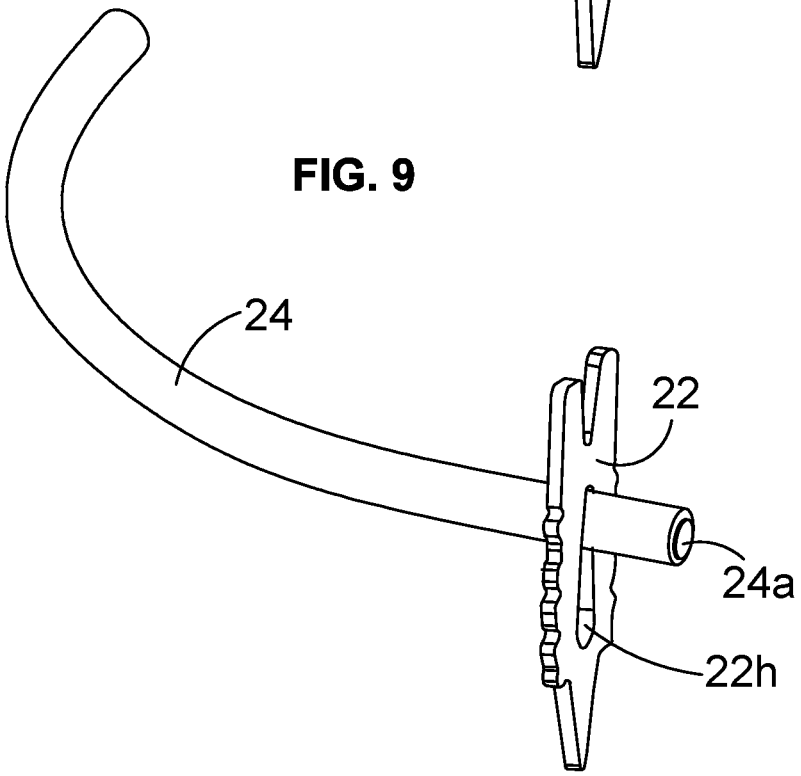

FIG. 9 shows a wire 24 in which an insulation layer has been removed from an inner conductor 24*a*. The conductor is arranged in the upper portion of the tapered opening 22*h* of a signal contact 22. FIG. 9 shows a wire 24 without the insulation layer removed but also arranged in the upper portion of the tapered opening 22*h* of a signal contact 22. During assembly, with the two signal contacts 22 arranged in the two outermost openings 18 in the top of the housing, the wires 24 are inserted into respective housing openings 28 which are in alignment with the signal contact openings so that the end of each wire passes through the respective signal contact opening 22*h*. As the contacts are driven into the belt, the wires remain stationary since they are supported by the housing adjacent the openings 28. Thus, the signal contacts 22 move downwardly from the position shown in FIG. 11 to the position shown in FIG. 12. The inner edges of the contacts on either side of the contact opening 22*h* slide along the wire during movement of the contact until they firmly grip or secure the conductor 24*a*. It will be appreciated that for a wire insulated to the end thereof as shown in FIG. 10, the edges of the contact opening are sufficient sharp to penetrate the insulation layer to bring the signal contact 22 into direct connection with the wire conductor 24*a*.

Figure 16:
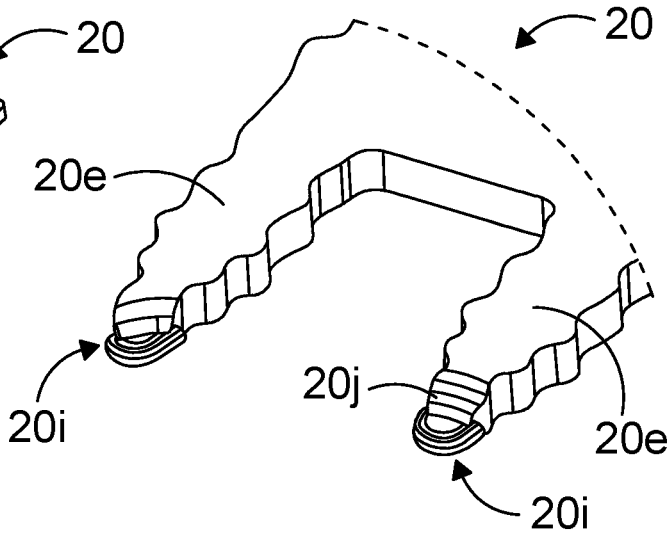
FIG. 16 is a detailed view of the pointed ends of the bridge contact taken along line A of FIG. 15.
Figure 17:
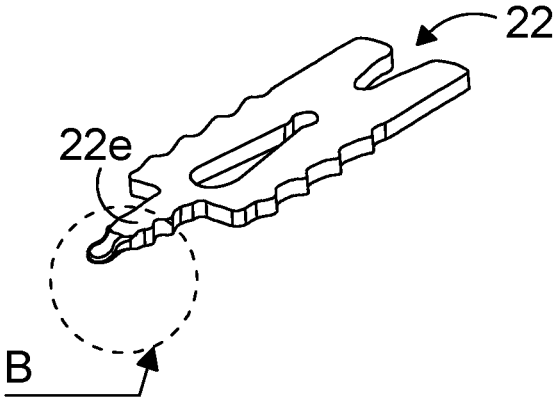
FIG. 17 is a perspective view of the signal contact shown in FIG. 8B.
Figure 18A:
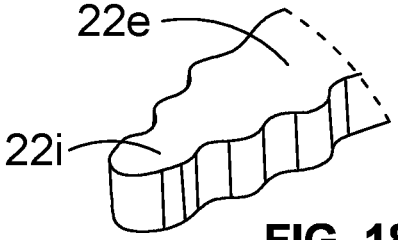
FIG. 18A is a detailed view of the pointed end of the signal contact taken along line B of FIG. 17.
Figure 18B:
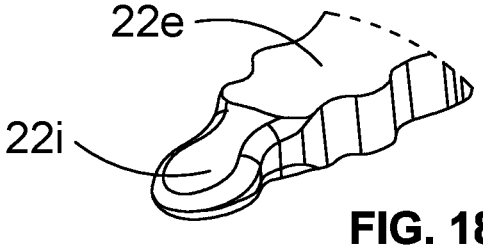
FIG. 18B is a detailed view of the end of the signal contact of FIG. 18A after machining to a tapered configuration.

To assist with piercing the elevator belt and the cords, the bridge 20 and signal 22 contacts have end portions which terminate in a point as shown in FIGS. 15-18. In addition, the end portions may have a thickness that progressively decreases in the direction of the point. Various configurations for the pointed ends are possible. For example, FIG. 16 shows pointed end portions 20*i* of bridge contact projections 20*e* having a stepped configuration 20*j*. The first step is at the pointed end, and a plurality of steps progressively increase the thickness of the projection end portion in a direction toward the bottom edge 20*d* of the contact. In addition, one or both of the end portions 20*i* may be arranged at an angle relative to the longitudinal direction. An angled end portion 20*i* is shown in the projection at the left of FIG. 16. This configuration will assist with retaining the contact within the belt. FIG. 17 shows a signal contact with a tapered end portion 22*i*. FIG. 18A shows the end portion 22*i* prior to tapering, i.e. in the configuration from the stamping machine from which the signal contact is formed. FIG. 18B shows the end portion 22*i* after tapering, such as by grinding, machining, or other suitable process.

Figure 19:
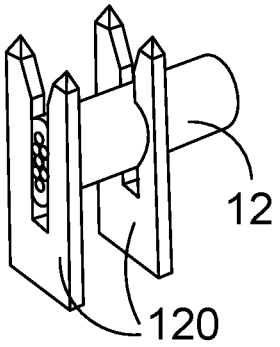
FIGS. 19 and 20 are perspective views of an alternate belt-piercing contact and arrangements for connection with a cord of an elevator belt, respectively.
Figure 20:
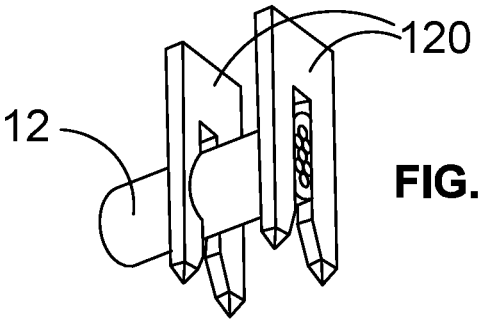

While the bridge and signal contacts according to the invention have been described as contacts which pierce into an elevator cord, it is possible to use other types of contacts which engage rather than pierce a cord. Once such contact is an insulation displacement contact (IDC) 120 which is shown in FIGS. 19 and 20. These contacts include a pair of spaced projections 120*e* which preferably have opposed liner surfaces or edges which typically are used to pierce through an insulation layer of a coated conductor wire. However, such contacts may also used in the subject elevator belt monitoring apparatus by forming the contacts with a space between the projections that corresponds with or is even slightly less than the width of an elevator cord. When properly positioned in openings in the housing of the monitoring system, the contacts may be driven into the belt so that the projections pierce the belt material and engage opposite sides of the cord to form an electrical connection therewith. In the configuration shown in FIG. 19, the contacts may be driven from the bottom of the housing to engage the cords 12. In the configuration shown in FIG. 20, the contacts may be driven from the top of the housing to engage the cords. If the contacts are to be used as bridge contacts, a metal bridge element can be connected with the main portion of the contact to join adjacent contacts which in turn electrically connect a pair of adjoining cords. If the contacts are to be used as signal contacts, an opening may be provided in the main portion of the contact to receive a wire.

It is also possible to utilize a housing formed of multiple sections. For example, a first housing may contain an input signal contact and one or more bridge contacts while a second housing configured for connection with the first housing contains an output signal housing and one or more bridge contacts. The housings are joined together and contain aligned slots which cooperate to receive the elevator belt.

While the preferred forms and embodiments of the invention have been illustrated and described, it will be apparent to those of ordinary skill in the art that various changes and modifications may be made without deviating from the inventive concepts set forth above.

What is claimed is:

1. An elevator belt monitoring apparatus, comprising (a) a housing for receiving an elevator belt; and (b) a plurality of belt-piercing contacts arranged in an array within said housing, each belt-piercing contact being configured to contact at least one cord within the belt and having a blade configuration including a top edge, side edges and a bottom edge including at least one projection, said top edge of said belt-piercing contacts containing a receptacle within which a tool may be arranged to force said belt-piercing contacts into the belt a sufficient distance to pierce at least one cord within the belt, said plurality of belt-piercing contacts including a pair of signal contacts having a single projection configured to pierce the cords adjacent to opposite side edges of the belt, respectively, said signal contacts containing an opening for connection with a signal wire.

2. An elevator belt monitoring apparatus as defined in claim 1, wherein said belt-piercing contact side edges having a sawtooth configuration.

3. An elevator belt monitoring apparatus as defined in claim 2, wherein each of said projections have side edges having a sawtooth configuration.

4. An elevator belt monitoring apparatus as defined in claim 3, wherein each of said projections extends in a longitudinal direction and includes an end portion terminating in a point which pierces a respective cord.

5. An elevator belt monitoring apparatus as defined in claim 4, wherein said contacts have a planar configuration and a thickness of said projection end portions progressively decreases toward said point.

6. An elevator belt monitoring apparatus as defined in claim 5, wherein said projection end portions have a stepped configuration.

7. An elevator belt monitoring apparatus as defined in claim 6, wherein said projection end portions are arranged at an angle relative said longitudinal direction.

8. An elevator belt monitoring apparatus as defined in claim 1, wherein each of said belt-piercing contacts includes a pair of projections which are spaced by a distance corresponding with a thickness of a cord, whereby when said contacts pierce the belt, the cord is contacted by opposed edges of said pair of projections.

9. An elevator belt monitoring apparatus as defined in claim 1, wherein said top edge of said belt-piercing contacts contains a receptacle, whereby a tool may be arranged in said receptacle to force said belt-piercing contact into the belt a sufficient distance to pierce at least one cord within the belt.

10. An elevator belt monitoring apparatus as defined in claim 1, wherein said signal contact openings are tapered, whereby as said signal contacts are forced into the belt, the wire is displaced to a narrow end of said opening to establish an electrical signal connection.

11. An elevator belt monitoring apparatus as defined in claim 10, and further comprising a monitoring device connected with said wires for delivering an electrical signal to said signal contacts and processing a return signal from said signal contacts to indicate a condition of the elevator cords.

12. An elevator belt monitoring apparatus as defined in claim 1, wherein said belt-piercing contacts comprise a plurality of bridge contacts having a pair of spaced projections configured to pierce a pair of adjacent cords, respectively, within the belt.

13. An elevator belt monitoring apparatus as defined in claim 12, wherein said housing includes a bottom portion which receives the elevator belt and a top portion removably connected with said bottom portion.

14. An elevator belt monitoring apparatus as defined in claim 13, wherein housing top portion contains a plurality of openings arranged in an array and said belt-piercing contacts are arranged in said housing top portion openings, respectively, whereby a drive assembly may be inserted into said housing top portion openings and pressed against said contact receptacles to drive said contacts through the elevator belt to engage respective cords.

15. An elevator belt monitoring apparatus as defined in claim 14, wherein said housing bottom portion includes a pair of side walls define a channel for receiving the elevator belt.

16. An elevator belt monitoring apparatus as defined in claim 15, wherein said housing bottom portion side walls include inwardly extending resilient members which press against edge portions of the elevator belt to position the elevator belt within said housing bottom portion with one of the cords within the elevator belt aligned with each of the contact projections.

17. A belt-piercing contact for an elevator belt monitoring apparatus, comprising a blade member having a top edge, a bottom edge, and side edges, said top edge containing a receptacle within which a tool may be arranged to force said belt-piercing contacts into the belt a sufficient distance to pierce at least one cord within the belt and said bottom edge including at least one projection, said at least one projection including an end portion terminating in a point for piercing an elevator belt and a cord arranged in the belt to electrically and mechanically connect said blade member with the cord, said blade member containing an opening for connection with a signal wire.

* * * * *